United States Patent [19]

Eberhardt

[11] Patent Number: 4,570,605

[45] Date of Patent: Feb. 18, 1986

[54] FUEL SUPPLY FOR A PISTON ENGINE

[75] Inventor: H. Alfred Eberhardt, Paoli, Pa.

[73] Assignee: Hale Fire Pump Company, Conshohocken, Pa.

[21] Appl. No.: 358,547

[22] Filed: Mar. 15, 1982

[51] Int. Cl.[4] ..... F02M 1/16; F02M 25/00

[52] U.S. Cl. ..... 123/576; 123/525; 123/526; 123/557; 123/27 GE; 123/187.5 R

[58] Field of Search ..... 123/525, 526, 27 GE, 123/576, 557, 187.5 R; 48/180.1

[56] References Cited

U.S. PATENT DOCUMENTS

| | | | |
|---|---|---|---|
| 2,943,766 | 7/1960 | Orr | 123/187.5 R |
| 3,379,185 | 4/1968 | Frisch | 123/180 R |
| 3,664,315 | 5/1972 | Kramer | 123/525 |
| 3,698,365 | 10/1972 | Hallberg | 123/525 |
| 3,789,820 | 2/1974 | Douglas et al. | 123/276 GE |
| 3,799,125 | 3/1974 | Hutchinson | 123/576 |
| 3,817,233 | 6/1974 | Kihn | 123/549 |
| 4,202,309 | 5/1980 | Burke | 123/180 AC |
| 4,346,683 | 8/1983 | Burke | 123/180 AC |
| 4,370,969 | 2/1983 | Zarrelli et al. | 123/525 |

FOREIGN PATENT DOCUMENTS

| | | | |
|---|---|---|---|
| 159949 | 10/1982 | Japan | 123/525 |
| WO82/02926 | 9/1982 | PCT Int'l Appl. . | |

*Primary Examiner*—E. Rollins Cross

*Attorney, Agent, or Firm*—Frank A. Follmer

[57] ABSTRACT

A dual fuel supply for a piston engine in which there is one fuel supply means for a running fuel of low volatility and another fuel supply for a starting fuel of high volatility. The starting fuel is contained in safe scaled pressurized cartridges. The temperature of the running fuel is raised to improve its combustion characteristics.

15 Claims, 8 Drawing Figures

FIG. 2
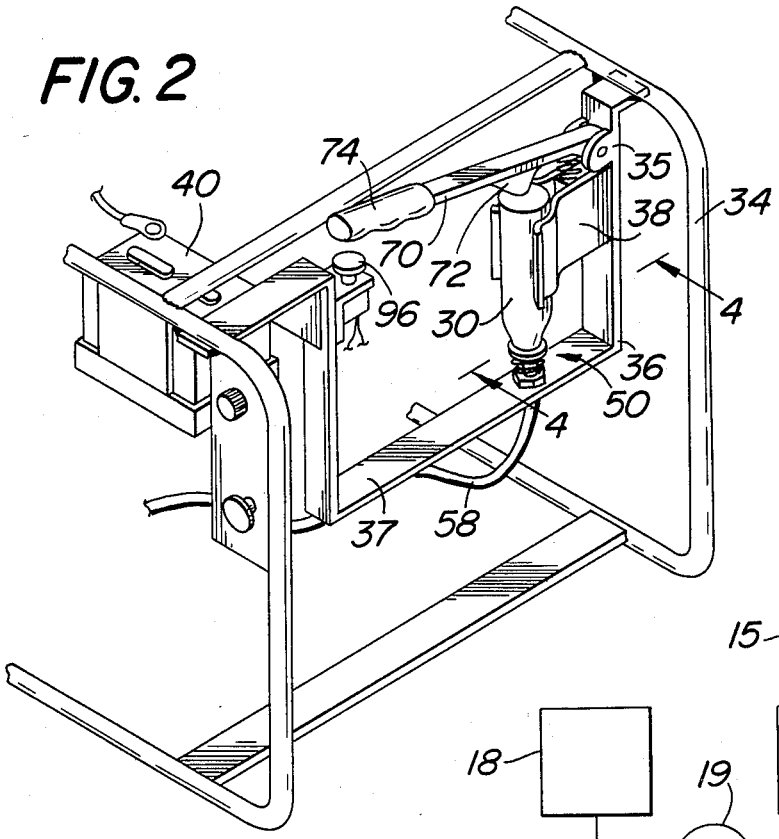
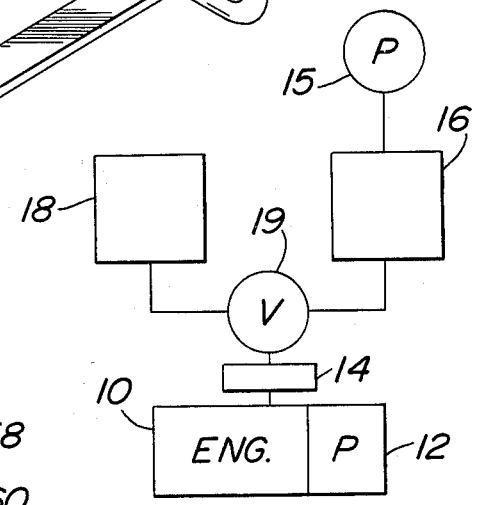
FIG. 1
FIG. 3
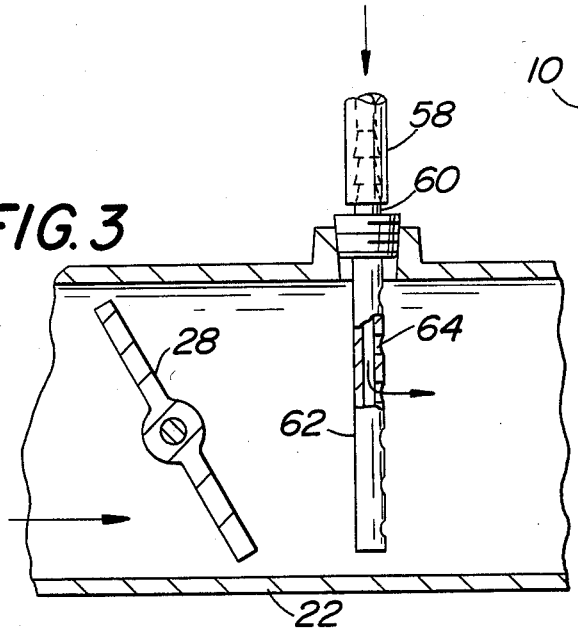

FIG. 8
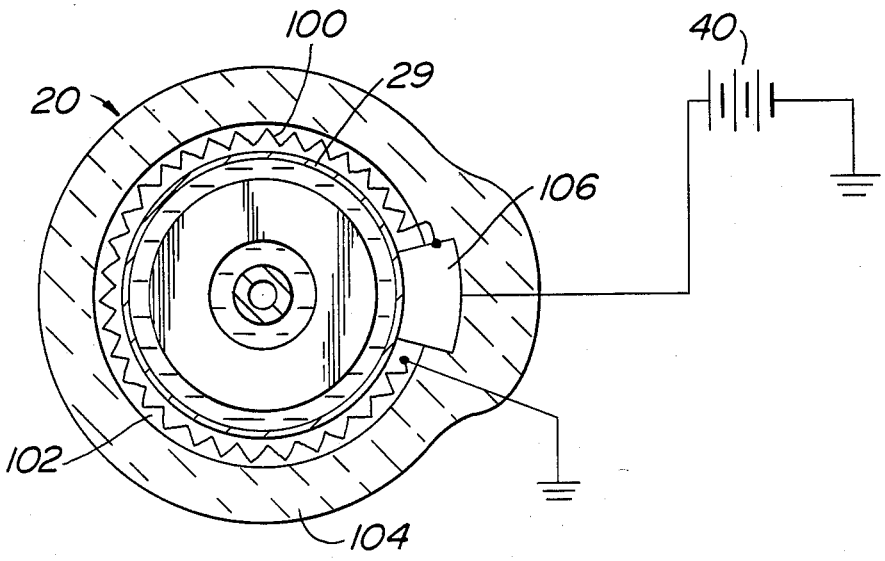
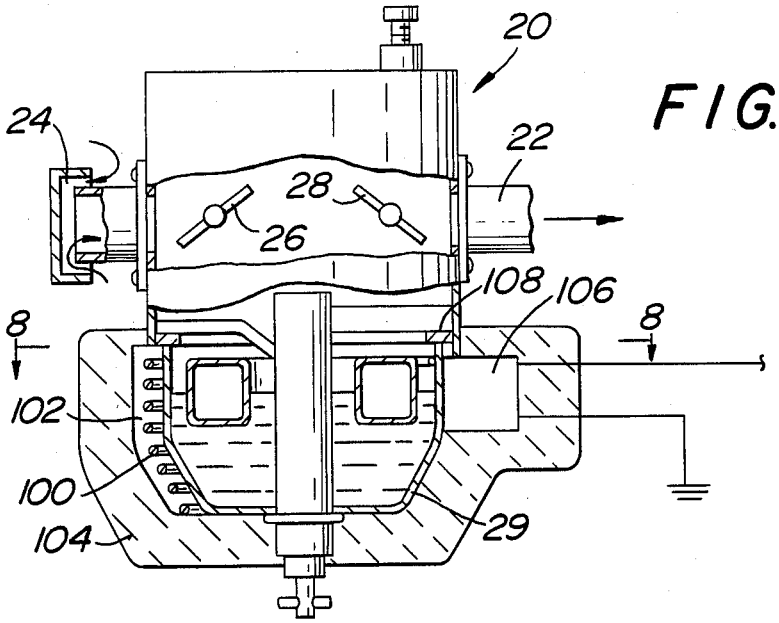
FIG. 7

FUEL SUPPLY FOR A PISTON ENGINE

BACKGROUND AND SUMMARY OF THE INVENTION

In many applications, such as on board ships, there is a need for a light-weight, reliable portable engine-pump unit. For example, such units are used as portable fire fighting pumps or dewatering pumps. Present-day engine-pump units of the indicated type generally utilize a two-stroke gasoline engine because this engine is light in weight. However, the use of a fuel such as gasoline involves inherent safety problems because of the dangerous nature of gasoline which is highly flammable.

A rotary piston engine (Wankel engine) is ideal for units of the indicated type because of its light weight, its compactness, and its high speed characteristics. Also, this engine would be safer because its combustion characteristics permit it to be run on diesel-type (low volatile) fuels easier than a two-stroke gasoline engine. However, this use has not occurred because of the difficulty in starting an engine with a diesel-type fuel.

It is the general object of this invention to provide a safe fuel supply means for a portable engine-pump unit of the indicated type. The fuel supply means of the invention eliminates the need for gasoline as a fuel supply on board ships for the purpose of running portable engine-pump units of the indicated type.

In accordance with the invention there is provided a engine-pump unit that utilizes a rotary piston engine (Wankel engine) which is provided with a dual fuel supply comprising means for supplying a running fuel of relatively low volatility for use in the normal operation of the rotary engine and means for supplying a starting fuel of high volatility for use in starting the rotary engine.

In accordance with a more specific feature of the invention the starting fuel supply means comprises a sealed pressurized cartridge containing a supply of the starting fuel. The cartridge is relatively small, structurally strong and explosion-proof. The starting fuel is preferably propane which may be connected directly to the induction pipe of the carburetor system.

In accordance with a more specific aspect of the invention there is provided means cooperable with discharge passage of the cartridge for opening the same to release the contained pressurized starting fuel, and a lever means for causing a penetrating mechanism to extend within the discharge passage of the cartridge for opening the same.

In accordance with a still further aspect of the invention there is provided means responsive to the movement of the lever means to open the cartridge for causing the engine starter switch to energize the starter means for the rotary engine.

It will be apparent that the fuel supply means of the invention obviates the need for the use of gasoline as a fuel supply for an engine-pump unit on board ship. Thus, the running fuel may comprise a suitable diesel-type fuel of low volatility and the starting fuel is contained in a safe storage arrangement by the use of the cartridges. The use of the cartridge supply arrangement obviates the need for any bulk storage of a dangerous fuel on board the ship.

In accordance with a further feature of the invention there is provided a small air pump that can be used to pressurize the running fuel supply means so as to provide a simple fuel injection system.

In accordance with another aspect of the invention there is provided means for raising the temperature of the diesel-type fuel supplied to the engine so as to improve the combustion efficiency of the rotary piston engine. In a typical reciprocating piston diesel engine air is drawn into the cylinder and is compressed to a very high ratio of about 14:1 to 25:1. This high compression causes the air in the cylinder to be heated to a temperature of 700°-900° C. This high temperature causes spontaneous ignition of the diesel fuel that is injected into the cylinder. On the other hand, a rotary piston engine only has a combustion ratio of about 7:1 thereby providing a temperature rise in the combustion chamber of only about half that of the typical diesel engine. Accordingly, there are problems in both starting and running a rotary piston engine with a diesel-type fuel. In accordance with the invention there is provided various means for obviating this problem by raising the temperature of the diesel-type fuel so as to increase the combustability thereof and thereby improve the running and starting performance of a rotary piston engine using diesel-type fuel.

One form of fuel heating means in accordance with the invention comprises an electric resistance heater for the fuel contained in the carburetor fuel bowl. This heater is energized from the engine starter battery and there is preferably provided a thermoswitch means to control the heating action so as to maintain a desired temperature of the fuel in the fuel bowl.

Other fuel heating means in accordance with the invention involve an electric resistance heater immersed in the fuel tank, a heating jacket for heating the fuel passing through the fuel line, which jacket can be mounted on the engine exhaust, and exothermic pellets that can be added to the fuel tank for heating the same by means of an exothermic reaction resulting from the dissolving of these pellets.

All of the above-described fuel heating means are thermally insulated where possible to prevent heat loss at their heating location.

BRIEF DESCRIPTION OF THE DRAWINGS

FIG. 1 is a schematic view of a dual fuel supply system in accordance with the invention.

FIG. 2 is a perspective view of a cartridge-type starting fuel supply means.

FIG. 3 is a view showing the introduction of the starting fuel into the carburetor induction pipe.

FIG. 7 is a side elevation, partly in section, of a heated carburetor fuel bowl in accordance with the invention.

FIG. 8 is a view taken on line 7—7 of FIG. 7.

DETAILED DESCRIPTION OF THE PREFERRED EMBODIMENTS

Figures 4, 5:
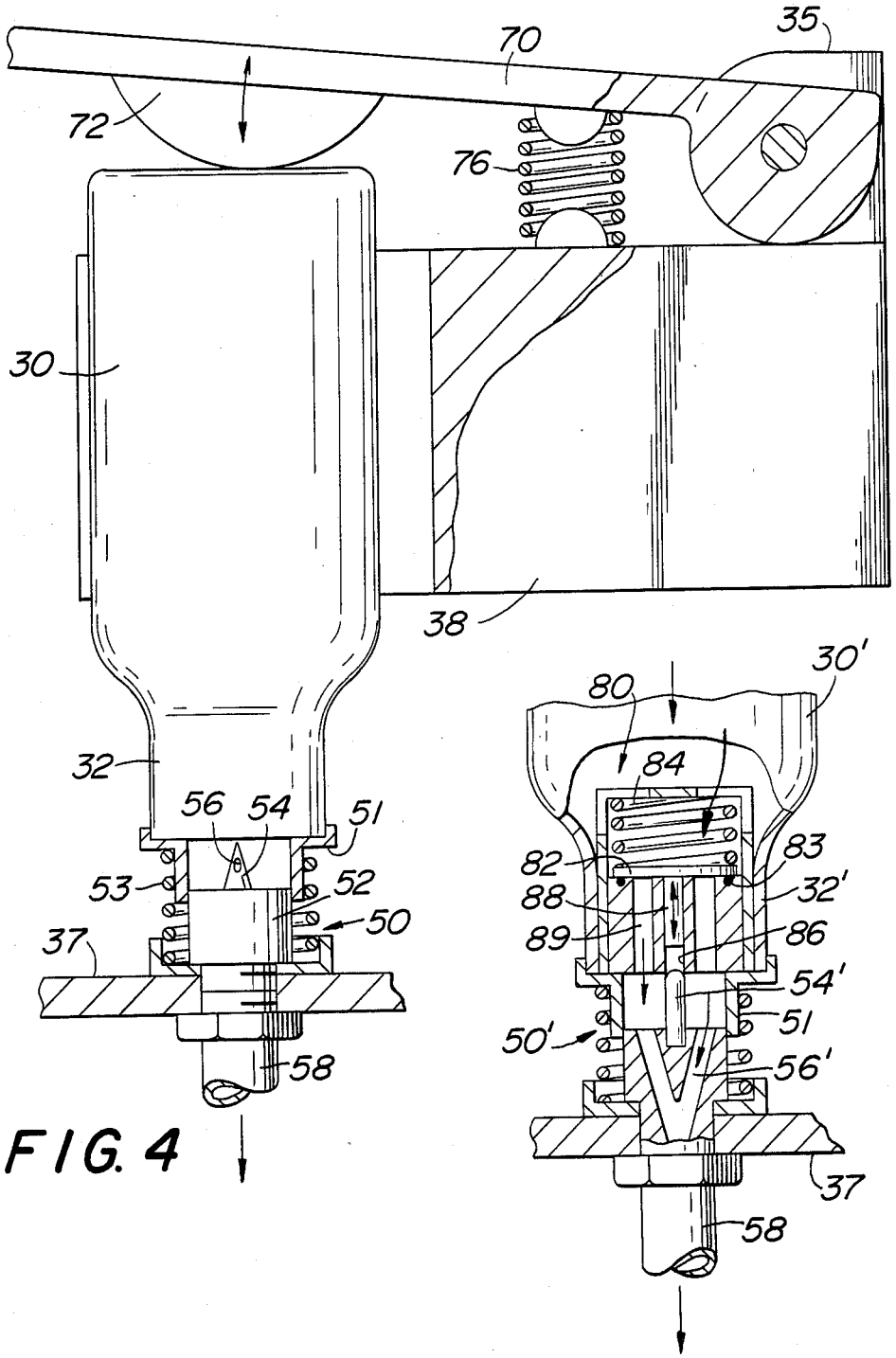
FIG. 4 is a view taken on line 4—4 of FIG. 2.
FIG. 5 is a view of a cartridge having a valve for controlling the discharge of starting fuel therefrom.

In FIG. 1 there is shown a schematic illustration of a dual fuel supply in accordance with the invention which comprises an internal combustion rotary piston engine (Wankel engine) 10 which drives a pump 12 and is provided with a fuel inlet means 14 for delivering a fuel-air mixture to the engine. There is also provided means 16 for supplying a running fuel to the fuel inlet means 14 for use in the normal operation of the rotary engine 10. This running fuel is a diesel-type fuel having a relatively low volatility, such as JP-5. There is also provided a means 18 for supplying starting fuel having a relatively high volatility to the fuel inlet means 14 for use in starting the rotary engine 10. Selecting means 19, in the form of a three-way valve or a similar control means, is provided for selecting whether the starting fuel or the running fuel is supplied to the fuel inlet means 18 of the rotary engine 10.

In the operation of the dual fuel supply system according to FIG. 1, the control means 19 is set to supply the starting fuel to the engine 10 when the engine is started up. Once the engine 10 is running, the control means 19 is moved to a position to supply the running fuel to the engine during the normal operation thereof.

As shown in FIG. 1, there may be provided a small air pump 15 arranged to pressurize the running fuel supply means 16. This arrangement, in effect, provides a simple, low cost fuel injection system.

In FIGS. 2 through 6 there is shown a preferred means for supplying the starting fuel to the engine, which means, briefly stated, comprises a cartridge for containing a highly volatile fuel such as liquid propane. Butane or ether may also be used as the starting fuel.

Figure 6:
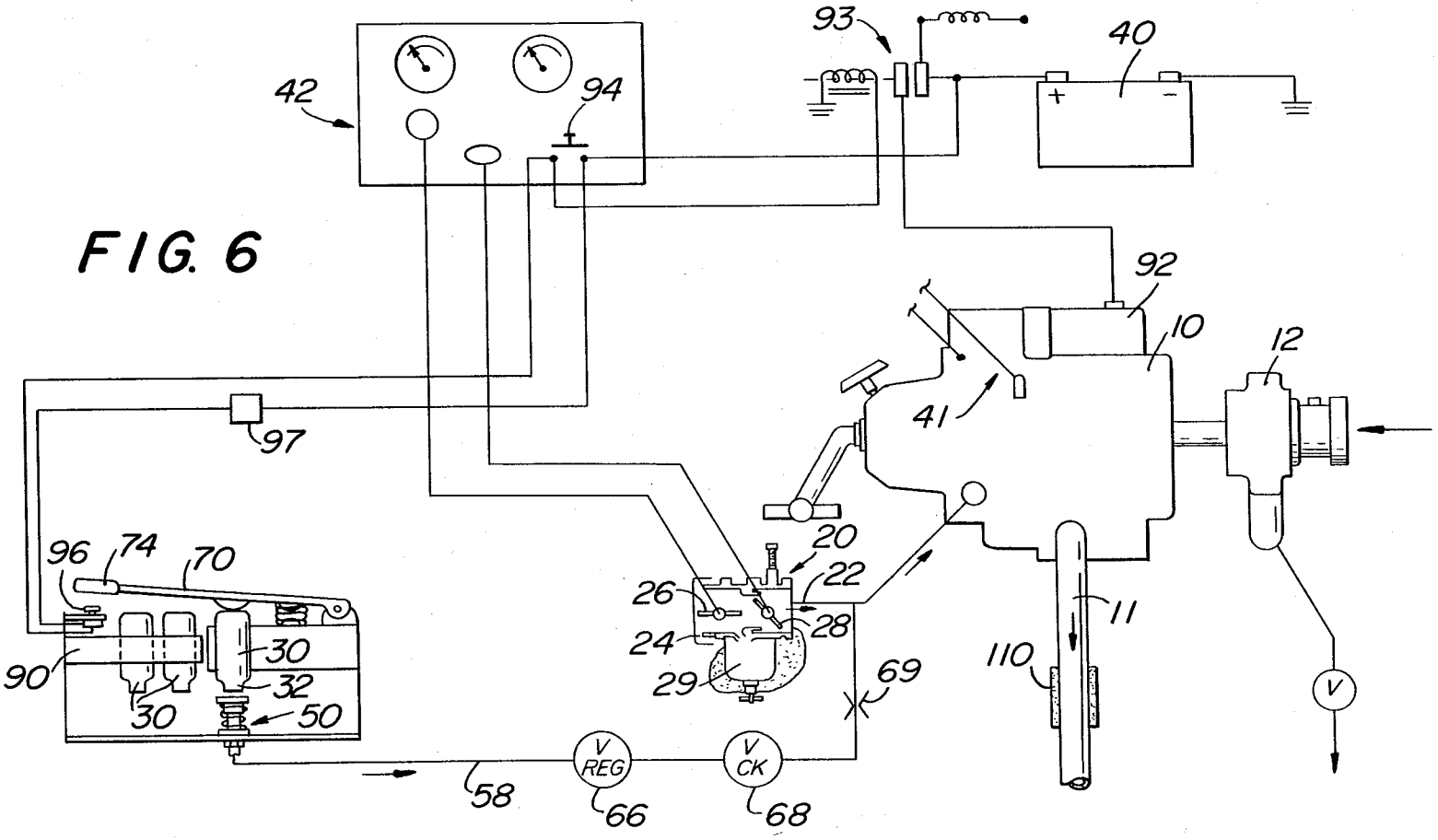
FIG. 6 is a schematic view of an engine-pump unit provided with a fuel supply in accordance with the invention.

As shown in FIGS. 6 and 7, the fuel inlet means comprises a carburetor system including a carburetor 20 and an induction pipe 22. Carburetor 20 produces a fuel-air mixture needed for the operation of the rotary engine 10 and delivers this mixture as a stream through the induction pipe 22 to the engine combustion chamber. As is conventional, in the carburetor 20 the fuel is distributed in the form of tiny droplets into the air stream which enters carburetor 20 through the inlet 24. These droplets absorb heat as they pass to the engine combustion chamber and are partially vaporized so that the mixture becomes partly an inflammable gas. The mixture is, of course, drawn into the engine cylinder through the induction pipe 22 during the induction phase (or stroke) of the engine. Carburetor 20 is provided with a conventional choke 26 and throttle valve 28 for regulating flow to the engine 10. Carburetor 20 is also provided with a fuel bowl 29 (also known as a float chamber) for containing a quantity of the running fuel to be supplied to the induction pipe 22 by way of a fuel line (not shown) from a fuel tank (not shown) for the running fuel. The level of the fuel in the bowl 29 is maintained by a conventional float arrangement which controls flow into the bowl 29 by way of a fuel inlet (not shown). The running fuel is delivered to the carburetor 20 through a small fuel outlet orifice located in a reduced diameter portion of the induction pipe 22 between the choke 26 and the throttle valve 28. This fuel outlet orifice is essentially a restriction in the fuel supply pipe from the fuel bowl 29 to the induction pipe 22 and limits the controls the quantity of fuel introduced into the air stream per unit time.

In the preferred embodiment of the invention, the starting fuel supply means comprises liquid propane contained under pressure in a sealed container such as a bottle-shaped cartridge 30. Cartridge 30 has a necked-down portion provided with a normally closed discharge passage 32. As is best shown in FIG. 2, cartridge 30 is mounted in an inverted position on a frame 34 for the engine-pump unit by means of a bracket 36 and a clamp 38. The frame 34 is a portable box-like structure on which is supported the engine 10, the pump 12, the carburetor system 20–29, the fuel supply tank, the starting battery 40, the spark plug 41, the control panel and controls 42 and all the essential parts necessary to provide a portable engine-pump unit.

There are provided manually operable means cooperable with the discharge passage of cartridge 30 for opening the same to release the pressurized propane gas starting fuel contained therein. To this end, there is provided a penetrating means 50 adapted to extend into the cartridge discharge passage 32 for opening the same to release propane. The form of penetrating means 50 shown in FIG. 4 is adapted for use with a cartridge of the type provided with a lead seal extending across the discharge passage 32. This type of cartridge is well known to the art. Penetrating means 50 is fixedly mounted on a horizontal leg 37 of the bracket 36 and comprises a cylindrical body portion 52 having a pointed prong 54 extending upwardly therefrom. The prong 54 is constructed to be able to penetrate the lead seal and is provided with flow passages 56 which are arranged to communicate with the interior of the cartridge 30 and to pass longitudinally through the penetrating mechanism 50 to deliver the propane gas to a flexible tubular fuel line 58. As is shown in FIG. 3, the fuel line 58 is connected to a fitting 60 mounted on the induction pipe 22 downstream of the throttle valve 28 for delivering the propane gas to a tube 62 extending across the interior of the induction pipe 22 and provided with small port openings 64 facing in the direction of air flow. As is shown in FIG. 6 the flexible tube propane gas fuel line 58 is provided with a suitable pressure regulator valve 66, a check valve 68 and a metering orifice 69 for controlling the supply of propane gas passing therethrough to the induction pipe 22.

As shown in FIG. 4, there is provided means for supporting the lower end of the cartridge 30 above and in alignment with the penetrating means 50 and for guiding the cartridge 30 onto the penetrating means 50. This support means comprises a cylindrical collar 51 adapted to receive the lower end of the cartridge 30 and a spring means 53 biasing the collar 51 to a position above the penetrating means 50. The collar 51 is slidably mounted on the cylindrical wall of the body portion 52 so that as the collar 51 slides downwardly onto the penetrating means 50 the point of the prong 54 will enter the discharge passage 32 for breaking the seal thereacross to release the pressurized propane gas contained in cartridge 30.

Lever means are provided for manually moving the cartridge 30 downwardly onto the penetrating means 50 against the bias of the spring means 53. To this end, a lever arm 70 is pivotally mounted at one end on a vertical leg 35 of the bracket 36 to extend across the top end of the cartridge 30 mounted on the clamp as shown in FIG. 2. At a medial portion of the lever arm 70 there is provided a downwardly extending knob 72 aligned with the top end of the cartridge 30. At its extended end the lever 70 is provided with a handle portion 74. Spring means 76 are provided for biasing the lever arm 70 to an inactive position (as shown in FIG. 4) in which the cartridge 30 is in an upper position out of engagement with the penetrating means 50. This spring means 76 and the spring means 53 cooperate to urge the lever arm 70 and the cartridge 30 to this inactive position.

In operation, when it is desired to supply the starting fuel to the engine 10, the lever arm 70 is depressed to thereby force the cartridge 30 downwardly onto the penetrating means 50. During this movement, both the spring means 53 and 76 are compressed and the collar 51 slides downwardly onto the cylindrical body portion 52 of the penetrating means 50 to guide the cartridge 30 onto the pointed prong 54. As the prong 54 passes through the lead seal across the discharge passage 32 of the cartridge 30, propane gas flows through the flow passages 56 in the penetrating means 50 and through the fuel line 58 to the fitting 60 whereat the propane gas is delivered into the induction pipe 22 through the small openings 64 as illustrated in FIG. 3.

In FIG. 5 there is shown another form of cartridge 30' for containing the propane gas. In this cartridge 30' the discharge passage 32' thereof is provided with a normally closed valve means 80 including a valve member 82 biased to a closed position (as shown in FIG. 5) by a valve spring 84. The valve member 82 is slidably movable upwardly to an open position against the bias of the valve spring 84. When a cartridge 30' is used, penetrating means 50' is provided with a cylindrical projecting prong 54' adapted to move into a cylindrical bore 86 in which a valve stem 88 of the valve member 82 is slidable. In operation, when the cartridge 30' is moved downwardly, it is guided onto the penetrating means 50 by the collar 51 and the prong 54' contacts the lower end of the valve stem 88 to move the valve member 82 upwardly out of contact with its valve seat 83 to permit flow through the valve passages 89 through which the propane gas passes when it is released. The propane gas then passes through passage means 56' in the penetrating means 50' and to the flexible fuel line 58 for passage to the induction pipe 22 as described above.

As shown in FIG. 6, the propane gas starting system may be provided with a rack 90 containing a plurality of the cartridges 30 in order to provide an adequate supply of the propane gas for the starting system.

The engine-pump unit is also provided with an electric starting motor 92 for use in starting the engine 10 and a storage battery 40 for supplying current to the starting motor 92. The supply of current to the starting motor 92 is controlled by a starting solenoid 93 which is activated upon depression of an engine start button 94 mounted on the control panel 42. In accordance with a feature of the invention, there is provided an additional engine start button 96 which is mounted on the bracket 36 below the handle 74 of the lever arm 70. The button 96 is arranged so that when the lever arm 70 is depressed to supply starting fuel to the engine 10, the handle 74 will contact the button 96 to cause energization of the starting motor 92 by the battery 40 in response to the closing of the starting solenoid 93. A suitable time delay 97 is provided in this circuit to avoid the possibility of running starting motor 92 for an excessive period of time.

In accordance with another feature of the invention there is provided means for raising the temperature of the running fuel to improve the combustion efficiency thereof. To this end, various means are provided for raising the temperature of the running fuel so that its combustibility will be improved.

One such means for raising the temperature of the running fuel is illustrated in FIGS. 7 and 8. Such means comprises a heater located to surround the fuel bowl 29 of the carburetor 20. This heater comprises a heater blanket 100 comprised of an insulated resistance wire, such as copper contained in a silicone covering. The heater blanket 100 extends around the fuel bowl 29 in a chamber 102 which is enclosed by a suitable insulation material 104, such as a refractor material as is shown in FIGS. 7 and 8. The heater blanket 100 is supplied with a heating current from the starter battery 40 by suitable circuit means as shown in FIG. 7. The supply circuit means comprises a thermoswitch 106 which senses the temperature of the fuel in the fuel bowl 29 and is set to open above a predetermined temperature to shut off the energizing current. For example, the thermoswitch may be set to open above 200° F. although the precise temperature may vary with the particular fuel used. As shown in FIG. 8, there is provided a thermal insulation gasket 108 between the heated fuel bowl 29 and the induction pipe portion of the carburetor 20 to thermally isolate the heated fuel bowl 29.

Another means for raising the temperature of the running fuel in accordance with the invention comprises an immersion heater which is located within the fuel tank for the running fuel. This immersion heater is an electric resistance heating means and is supplied with a controlled heating current from the storage battery in the same manner as the heater blanket 100 described above with respect to FIGS. 7 and 8.

Another form of means for raising the temperature of the running fuel in accordance with the invention comprises an electrical heating jacket associated with the fuel line from the fuel tank for the running fuel to the carburetor.

In FIG. 6 an alternative running fuel heating method is shown comprising a heat transfer jacket 110 which surrounds a portion of the engine exhaust pipe 11. Jacket 110 contains running fuel in a heat transfer relationship with the hot exhaust gases and is located between the running fuel supply and the carburetor.

Another form of means for raising the temperature of the running fuel in accordance with the invention comprises a supply of time released capsules containing two different chemicals in the form of one or more coated capsules, the composition of the two chemicals being such that they will react exothermally. The capsule coating is of a composition that will dissolve in the running fuel to allow an exothermic reaction to take place. This reaction serves to raise the temperature of the running fuel contained in the fuel tank. Various types of capsules containing suitable chemicals well known in the art for producing an exothermic reaction of the indicated type may be provided.

I claim:

1. A fuel supply for an internal combustion engine having a fuel inlet means for delivering a fuel-air mixture to the engine combustion chamber comprising:

means for supplying a running fuel to the fuel inlet means for use in the normal operation of the engine, said running fuel having a relatively low volatility, and means for supplying a starting fuel to the fuel inlet means for use in starting the engine, said starting fuel having a relatively high volatility, said starting fuel supply means comprising a sealed pressurized cartridge containing a limited supply of said starting fuel, said cartridge having a discharge passage closed by a valveless permanent seal of penetrable material extending across the discharge passage and including means cooperable with said penetrable material closing said discharge passage for penetrating the same to release all of the limited supply of said pressurized starting fuel contained in said cartridge.

2. A fuel supply according to claim 1 including means for raising the temperature of said running fuel to improve the combustion efficiency thereof.

3. A fuel supply according to claim 2 wherein said starting fuel is propane and the fuel inlet means comprises a carburetor system having an induction pipe through which a stream of combustion air passes, said propane being delivered directly to said induction pipe.

4. A fuel supply according to claim 2 wherein said fuel supply means comprises a carburetor having a fuel bowl for containing a supply of said fuel and including a heater located in the proximity of said fuel bowl for heating the fuel contained therein.

5. A fuel supply according to claim 2 wherein said fuel supply means comprises a fuel tank and including an electric heating element immersed in said fuel tank for heating the fuel contained therein.

6. A fuel supply according to claim 2 wherein said fuel supply means comprises a fuel tank and a fuel line extending therefrom to the engine, and including an electric heating jacket enclosing a portion of said fuel line for heating the same.

7. A fuel supply according to claim 2 including a heat transfer jacket located on the exhaust line of said engine, said jacket being in heat transfer relationship with the running fuel supply.

8. A fuel supply according to claim 2 including a supply of capsules adapted to be dissolved in said running fuel to produce an exothermic reaction to apply heat to said running fuel.

9. A fuel supply according to claim 1, wherein said starting fuel is propane.

10. A fuel supply according to claim 1 including a plurality of said permanently sealed cartridges positioned in a storage rack at a stored location near the engine.

11. A fuel supply according to claim 1 wherein said releasing means comprises a penetrating means including a prong adapted to extend into said discharge passage to penetrate said permanent seal to release the limited supply of pressurized fuel therein.

12. A fuel supply according to claim 11 wherein there is provided actuating means causing said penetrating means to enter said discharge passage to cause the opening of the same.

13. A fuel supply according to claim 12 wherein said actuating means includes a manually operated lever.

14. A fuel supply according to claim 13 wherein said engine is provided with a starter means controlled by a starting switch and including means responsive to the movement of said lever to open said cartridge for causing said starting switch to actuate the said engine starter.

15. A fuel supply according to claim 1 including pump means for pressurizing said running fuel supply to provide a simple fuel injection system for said engine.

* * * * *